US005488355A

United States Patent [19]

Tindall et al.

[11] Patent Number: 5,488,355

[45] Date of Patent: Jan. 30, 1996

[54] INTEGRATED SPECTRAL FLAME MONITOR

[75] Inventors: David Tindall; Malcolm Sarjeant, both of Berkshire, England

[73] Assignee: Spectus Limited, Berkshire, England

[21] Appl. No.: 325,109

[22] Filed: Oct. 17, 1994

[30] Foreign Application Priority Data

Oct. 22, 1993 [GB] United Kingdom ..... 9321810

[51] Int. Cl.[6] ..... G08B 17/12

[52] U.S. Cl. ..... 340/578; 250/339.15; 431/79

[58] Field of Search ..... 340/578; 250/339.15, 250/372, 395; 431/13, 79, 80, 75

[56] References Cited

U.S. PATENT DOCUMENTS

| | | | |
|---|---|---|---|
| 2,840,146 | 6/1958 | Ray | 431/79 |
| 3,665,440 | 5/1972 | McMenamin | 340/578 |
| 4,039,844 | 8/1977 | MacDonald | 340/578 |
| 4,709,155 | 11/1987 | Yamaguchi et al. | 340/578 |
| 5,126,721 | 6/1992 | Butcher et al. | 431/13 |

*Primary Examiner*—Glen Swann
*Attorney, Agent, or Firm*—Laubscher & Laubscher

[57] ABSTRACT

An oil flame monitoring system has an ultraviolet flame detector 1 and an infra red Flicker flame detector 2. The UV flame detector views a region 11 of the flame 5 known as the primary combustion zone which is situated about 1 to 2 metres downstream of a fuel atomizer 4. The IR Flicker flame detector 2 views a region 3 of the flame 5 inside the fuel oil spray just downstream of the fuel atomizer 4. A programmable logic controller processes the outputs of the two detectors 1, 2 and provides information about the position of the flame front and the quality of the flame.

10 Claims, 2 Drawing Sheets

INTEGRATED SPECTRAL FLAME MONITOR

STATEMENT OF THE INVENTION

The present invention relates to integrated spectral oil flame monitors.

Oil flame monitor for providing information regarding the presence of an oil flame and its condition are used to detect the presence of an oil flame, and it is an implicit requirement that they should be able, at the same time, to discriminate both between adjacent oil flames, when they are present, as well between an oil flame and its environment.

There are two methods of detecting the presence of oil flames which are in common use. The first detects light emitted from oil flames in the visible and infra-red wavelength bands, and this type of flame detector is known as an Infra Red or IR flame detector. A more developed IR flame detection technique is known as IR Flicker flame detection. The other technique is to detect Ultra Violet light which is also emitted by oil flames, which is known as a UV flame detector.

These oil flame detecting techniques have been successively developed over time and they have been established as the preferred methods for the task. However, neither of the individual UV or IR Flicker flame detection techniques is able to provide information about the oil flame other than to confirm its presence or absence as the case may be.

SUMMARY OF THE INVENTION

In accordance with a primary object of the present invention there is provided an oil flame monitor which utilizes a plurality of flame detectors in such a way as to enable a judgement to be made about the flame condition as well as its presence.

A preferred embodiment of the invention provides an oil flame monitor (termed herein an integrated spectral flame monitor) which combines the best features of contemporary UV and IR Flicker flame monitoring technology to provide information concerning the quality of an oil flame as well as detecting its presence.

The preferred integrated spectral flame monitor dedicates these two flame detection techniques to one oil burner as follows:

1. An IR Flicker flame detector to monitor the position of the flame front as well as confirm the presence of an oil flame.

2. A UV flame detector to monitor the quality of the oil flame and to confirm its presence.

To fulfil its role, the IR Flicker flame detector is arranged to monitor the oil flame at its origin, i.e. in the recirculation zone generated by the oil burner's flame stabilizer. The UV flame detector, on the other hand, monitors the primary combustion zone of the oil flame about 1 metre or so from its origin.

By monitoring these two distinct zones of the flame in this way, it is possible to detect a flame going unstable before a flame out condition is reached and at the same time monitor flame quality.

The specific advantages of IR Flicker flame are:

1. that of its discriminatory capability, and 2. that the infra-red/visible wavelengths are not as strongly susceptible to attenuation by oil mist and combustion products as, for example, is UV.

This latter feature is particularly important when viewing the origin of the flame through the oil spray just downstream of the flame stabilizer.

IR Flicker flame detection refers to the dynamic frequency of "flicker" associated with the visible and infra-red wavelength bands generally in the range 400–1,000 nanometres (nm). Flicker corresponds to intensity fluctuations and, in oil flames, these are generated by combustion in turbulent gaseous eddies as they are convected in the flame envelope. However there will also be a fundamental flicker, typically around 25 Hz, affecting IR from the flame and the environment because of air currents and the like. For this reason higher frequency IR flicker detectors will provide better discrimination as opposed, for example, to detectors which refer to fundamental flicker where attention is focused on the biggest signal.

The preferred window for discriminatory flame detection utilizing dynamic frequency is likely to be in the range 100–1000 Hertz (Hz), with the range of 400–700 Hz being most common.

The choice of optimum dynamic frequency within this range, for the purpose of discriminatory flame detection, is dependent largely on boiler conditions, but it is also influenced by fuel type, burner geometry and atomising factors.

To apply IR Flicker it is first necessary to characterize the optimum dynamic frequency for the boiler/burner situation and set the detector to accept flicker frequencies within a narrow band either side of the optimised value. At the same time as optimising the discriminatory capacity of the detector, it is necessary to arrange its installation by appropriate adjustment means to view the flame at its origin.

This adjustment may be described as spatial resolution and the technique builds on the second advantage of IR Flicker detection, which is its ability to view through an oil spray.

With this arrangement, any movement of the flame front from its origin is signalled by the detector. Moreover, a flame front which has its origin inside the oil spray can be said to be superior to one that has a flame front originating from its extremes. In this way the flame detector can be utilized to signal any change in flame quality which is derived from a movement of the flame front and a concomitant diminution of intensity of the detected signal at the dynamic frequency.

A UV flame detector has been selected to monitor the oil flame in its primary combustion phase a metre or so downstream of the stabilizer. Oil flames radiate over a wide range of wavelengths but it is generally only in the high temperature, primary combustion phase of oil flames that ultra-violet light is present in significant quantities over a relatively narrow spectral band (200 to 350 nm). At wavelengths below 300 nm, ultra-violet light is not emitted in detectable quantities from incandescent surfaces at the temperatures which exist near oil flames (1600° C.); neither is it generated by artificial or natural light.

By restricting the UV flame detectors to the shorter wavelength radiation, discrimination between neighbouring oil burners and between oil burners and their environment is achieved. It is intended to operate in conjunction with the IR Flicker flame detector described in the preceding passages.

As UV radiation is highly susceptible to absorption by oil mist and combustion products, including smoke, any deterioration of combustion in the main body of the flame will be picked up by the UV detector as a reduction in signal strength. Thus, the UV detector can indicate a deterioration in combustion performance.

The preferred integrated spectral flame monitor (ISFM) processes the output from separate IR Flicker and UV flame detectors using a programmable logic controller.

In its basic format the ISFM has been designed to incorporate the highly discriminatory characteristics of its IR Flicker and UV flame detectors, and to combine their other complementary strengths into one system. Notably, the IR Flicker flame detector output is not significantly attenuated by the oil spray, and the UV flame detector, on the other hand, signals brightness which is an indicator of flame quality.

In this way the ISFM achieves not only definitive and reliable flame monitoring under a variety of operating conditions, but it can also provide information about the position of the flame front and the quality of the flame.

Thus, the principal advantages of the ISFM utilizing two different flame monitoring devices are:

1. It provides discriminatory information, only shutting down the oil burner if both devices indicate a "flame out".

2. Enhanced system redundancy. Both flame detectors must fail before an oil furnace is shut down.

3. It utilizes the different advantages of the two flame detectors to provide qualitative information concerning flame quality.

BRIEF DESCRIPTION OF THE DRAWINGS

In order that the invention may be well understood, the preferred embodiment thereof, given by way of example, will now be described in more detail and with reference to the accompanying drawings, in which.

DETAILED DESCRIPTION

Figure 1:
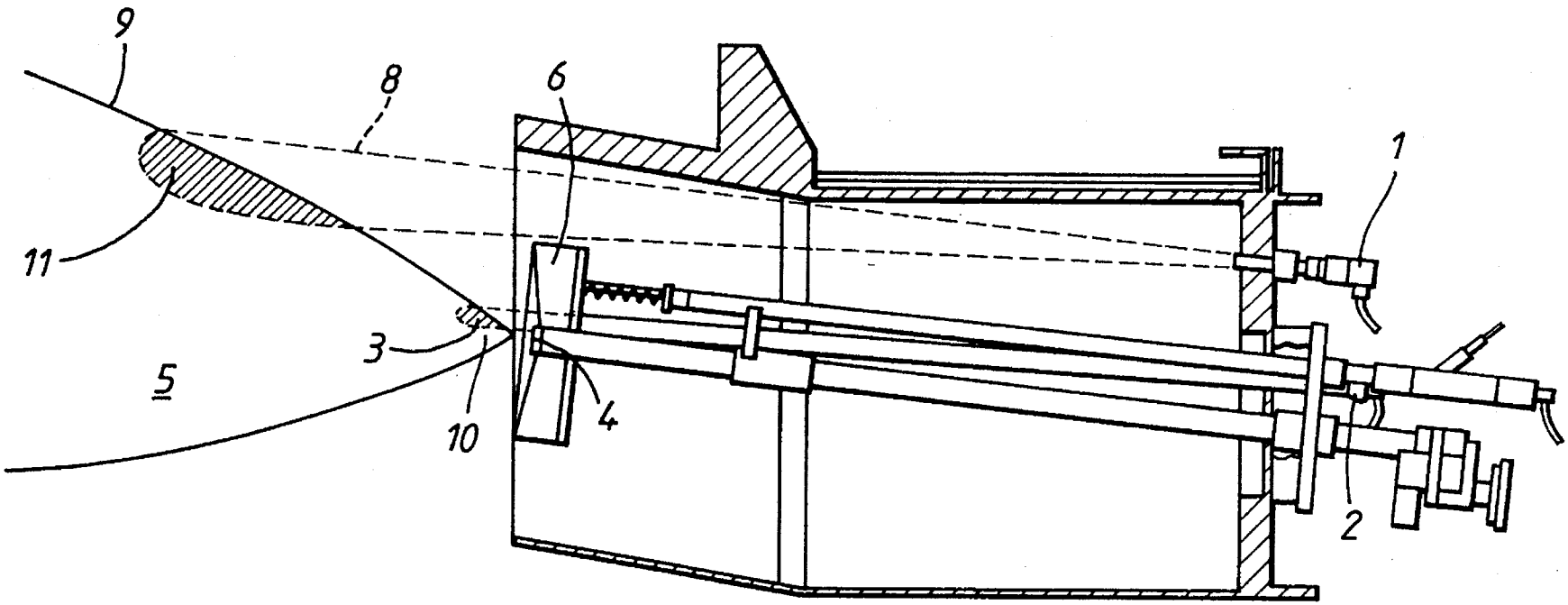
FIG. 1 is a cross-sectional view of an integrated spectral flame monitor (ISFM) embodying the invention.

Referring first to FIG. 1, an integrated spectral flame monitor (ISFM) includes two detector heads 1 and 2 for monitoring the oil flame and which are inset to fixed alignment tubes. One of those detector heads, an IR Flicker flame detector head 2 will view the region 3 of the flame 5 inside the fuel oil spray just downstream of the fuel atomizer 4, and the other, a UV flame detector head 1 will view the region 11 of the flame 5 known as the primary combustion zone which is about 1 to 2 metres downstream of the fuel atomizer 4.

The flame envelope is indicated by the solid line 9 and the field of view of the UV flame detector head 1 is shown as a broken line 8. The region where the flame envelope 9 and the field of view of the UV flame detector head 1 intersect is the UV source 11 for the UV flame detector head. The flame origin is at 10.

To explain fully the philosophy underlying the ISFM, it is necessary, first, to consider the structure of aerodynamically suspended flames, which can be stabilized in one of two ways. First, with the origins of the flame inside the fuel oil spray creating a candle of flame (the "flame candle") which is almost attached to the fuel atomizer 4 and, second, with the origins of the flame in a plane which bisects the extreme of the fuel oil spray, a "standing off" flame.

Figure 2A:
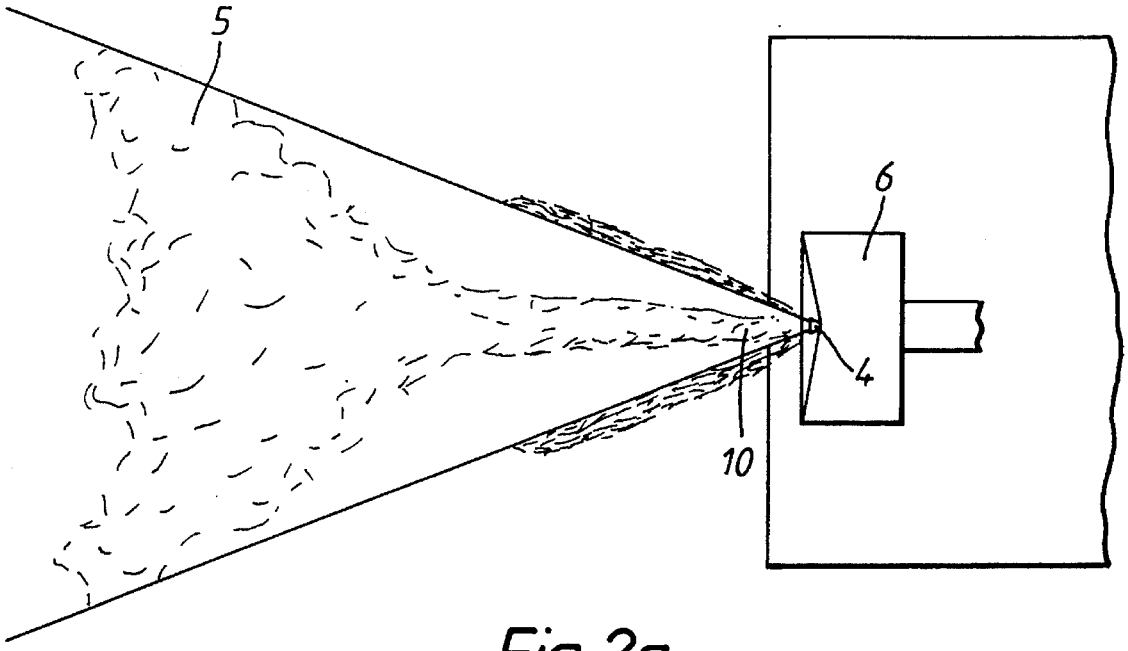
FIG. 2*a* illustrates a flame having its origins inside the fuel oil spray, creating a candle of flame.

The former flame stabilizing mechanism which creates a flame candle, as illustrated in FIG. 2*a*, occurs when the flame is properly ignited; this is the result of creating a self supporting ignition process right inside the fuel oil spray, a flame candle, from which the flame front is developed.

This results from recirculating hot gases and reacting particles in the recirculation zone generated by a flame stabilizer 6. The flame candle is the preferred form of ignition, because it can achieve the superior combustion performance of which only aerodynamically suspended flames are capable.

Figure 2B:
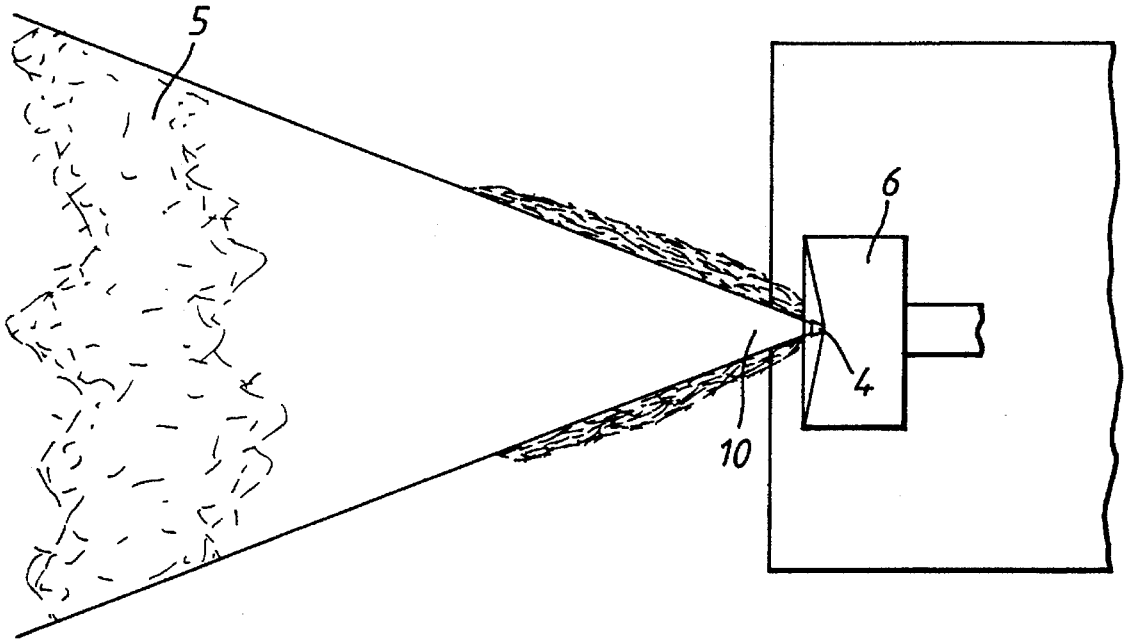
FIG. 2*b* illustrates a flame with origins in a plane bisecting the extremes of the fuel oil spray (a "standing off" flame).

The standing off flame, as illustrated in FIG. 2*b*, is typical of a flame which has not been properly ignited by its ignition device. In this case the flame front moves randomly as ignitable mixtures search for a source of ignition; they can be stabilized at a point downstream from the burner outlet where the burning velocity of the fuel/air mixture is equal to the velocity of the jet. Although, this type of flame gives an impression of an unstable flame condition, it is in fact perfectly safe provided, of course, that the transfer velocities of reacting particles do not exceed the rate of flame propagation.

Under upset of transient conditions, then, with a standing off flame it is possible for the flame front to move downstream and the flame to be extinguished. By monitoring the internal recirculation zone directly, it is possible to determine whether a flame is standing-off.

The task for the IR Flicker flame detector head 2 will, therefore, be to look for a flame candle.

In many multiple burner installations the distribution of combustion air to the oil burners is not equal. Thus, even though an IR Flicker flame detector may be signalling the presence of a flame candle, and hence superior combustion performance, in reality, insufficient or badly distributed combustion air may be impairing combustion in the primary phase of the flame. This will cause smoke at its edges and diminished levels of brightness.

The task for the UV flame detector head 1 will, therefore, be to monitor the brightness in the primary phase of the flame 5, to obtain a measure of its combustion performance.

Considered together, then, given confirmation from the IR Flicker flame detector head 2 that the flame candle exists, and obtaining a high reading from the UV flame detector head 1, it is reasonable to determine that the burner condition is optimised and that a high quality flame exists: one that is stable and will exhibit superior combustion performance.

Clearly, different combinations of signal from these two complementary flame detector heads 1 and 2 will advise a range of flame conditions data. Data embracing several intermediate conditions which might be undesirable but nevertheless are intrinsically safe, somewhere between that condition which exists when a flame is unsafe and will be shut down and the optimised condition described here.

For example, when firing oil burners to start a cold boiler it can be difficult to obtain sufficient UV output to lock in the oil burners, perhaps, because of insufficiently heated fuel oil or cold combustion air.

In these conditions, it is sometimes not possible to establish a flame candle; a flame which does not burn inside the oil spray tends to generate more carbon particles which persist to give higher particulate emissions, and smoke.

Thus, the IR Flicker flame detector head 2 and the UV flame detector head 1 may operate to shut down the oil burner in circumstances when, in fact, a stable and safe flame exists, albeit smoky.

For this reason, then, for boiler start the UV flame detector head 1 will be programmed with a level for acceptable brightness at start up which is lower than for the run condition.

Generally, in operation, the system would be programmed so that provided either one of the UV 1 or IR Flicker 2 flame detector heads indicates flame present, then, the burner will not be shut down by its controller. However, in these circumstances the operator will be given an unsatisfactory signal requiring prompt investigation.

While the absence of simultaneous 'high' signals from the UV 1 and IR Flicker 2 flame detector heads may be undesirable, it is not intrinsically unsafe. Only when both detector heads show 'low' signals is there a flame-out situation, in which case the oil valve is shut rapidly.

As a further point, a difference in ignition pattern in a flame can effect Nox emissions. Thus, a delay in ignition such as in a standing-off flame enables greater fuel/air mixing to take place before combustion commences. The greater availability of oxygen, then results in higher levels of Nox being generated.

The integrated spectral flame monitor system has been designed to utilize the highly discriminatory characteristics of its IR Flicker 2 and UV 1 flame detector heads and to combine their complementary strengths. In this way, the ISFM system achieves definitive and reliable flame monitoring under a variety of operating conditions; it can also provide information about the position of the flame front and the quality of the flame. The basic logic to be employed is set out at Table 1 below:

TABLE 1

| Flame Detector Outputs | | |
|---|---|---|
| Ultra Violet | Infra Red | Oil Burner Status |
| High | High | Flame stable, Combustion Good, Fuel Valve held open. |
| Low | High | Flame stable, but combustion deteriorating, Fuel Valve held open. Operator to investigate. |
| High | Low | Flame standing off, combustion deteriorating, Fuel Valve held open. Operator to investigate and try relighting the Flame. |
| Low | Low | Flame extinguished, Fuel Valve closed. |

The integrated spectral flame monitor processes the flame detector outputs using a programmable logic controller (PLC) which then gives the operator audible and/or visual indications of an unsatisfactory or unsafe flame. Suitable processing means other than a PLC could equally be used.

We claim:

1. An oil flame monitor, comprising:

(a) a first flame detector for viewing a first region of a flame produced by an oil atomizer, (b) a second flame detector for viewing a second region of the same flame, (c) said first and second flame detectors monitoring different characteristics of the flame for deriving qualitative information about the flame, and (d) means for processing the outputs of said first and second flame detectors to provide information about the position of the flame front and the quality of the flame.

2. An oil flame monitor system as claimed in claim 1, wherein the first flame detector monitors the brightness in the first region of the flame to obtain a measure of combustion performance.

3. An oil flame monitor as claimed in claim 2, wherein the first flame detector is an ultra-violet flame detector.

4. An oil flame monitor as claimed in claim 1, wherein the first region of the flame is the primary combustion zone which is situated about 1 to 2 metres downstream of the fuel atomizer.

5. An oil flame monitor as claimed in claim 1, wherein the second flame detector looks for the presence of a flame candle.

6. An oil flame monitor as claimed in claim 5, wherein the second flame detector is an infra-red flicker flame detector.

7. An oil flame monitor as claimed in claim 1, wherein the second region of the flame is inside the fuel oil spray just downstream of the fuel atomizer.

8. An oil flame monitor as claimed in claim 1, wherein said processing means uses the outputs of the first and second flame detectors to provide information about the position of the flame front and the quality of the flame.

9. An oil flame monitor as claimed in claim 1, wherein the processing means is a programmable logic controller.

10. An oil flame monitor as claimed in claim 1, wherein the processing means given an audible and/or visual indication of an unsatisfactory or unsafe flame.

* * * * *